US010010758B2

(12) United States Patent
Osler et al.

(10) Patent No.: US 10,010,758 B2
(45) Date of Patent: Jul. 3, 2018

(54) EXERCISE CHAIR

(71) Applicants: Turner Osler, Colchester, VT (US); Alexis Osler, Colchester, VT (US)

(72) Inventors: Turner Osler, Colchester, VT (US); Alexis Osler, Colchester, VT (US)

(73) Assignee: Kinetic Furniture of Vermont, LLC, Colchester, VT (US)

( * ) Notice: Subject to any disclaimer, the term of this patent is extended or adjusted under 35 U.S.C. 154(b) by 0 days.

(21) Appl. No.: 14/947,675

(22) Filed: Nov. 20, 2015

(65) Prior Publication Data

US 2017/0021230 A1 Jan. 26, 2017

Related U.S. Application Data

(63) Continuation-in-part of application No. 29/540,540, filed on Sep. 25, 2015.

(Continued)

(51) Int. Cl.

*A63B 26/00* (2006.01)
*A63B 22/14* (2006.01)

(Continued)

(52) U.S. Cl.

CPC ..... *A63B 26/003* (2013.01); *A47C 9/002* (2013.01); *A47C 9/02* (2013.01); *A63B 21/0004* (2013.01); *A63B 23/02* (2013.01)

(58) Field of Classification Search

CPC ..... A63B 26/003; A63B 22/16; A63B 22/18; A63B 21/0608; A63B 21/015;

(Continued)

(56) References Cited

U.S. PATENT DOCUMENTS 409,893 A 8/1889 Wray
4,552,404 A 11/1985 Congleton (Continued)

FOREIGN PATENT DOCUMENTS

DE 296 07 150 U1 8/1996
DE 297 04 664 U1 5/1997

(Continued)

OTHER PUBLICATIONS

DE20110832U1 Engish Translation Published Dec. 13, 2001.*

(Continued)

*Primary Examiner* — Nyca T Nguyen

(74) *Attorney, Agent, or Firm* — Justin W. McCabe; Dunkiel Saunders Elliott Raubvogel Hand, PLLC

(57) ABSTRACT

A device for moving the back and core muscles while sitting includes a rocking assembly that sits atop a base assembly, and optionally a height adjustment mechanism between the rocking assembly and the base assembly. The rocking assembly further includes a rocking mechanism that sits between a base plate or platform and a seat. The rocking mechanism can be, for example, a hollow or solid hemispheric- or dome-shaped rocking mechanism, an eccentric bicylinder rocking mechanism, and/or a rocking mechanism based on an arrangement of halfpipe members. The rocking mechanisms of the exercise chair allow to the seat to rock, wobble, and/or swivel with a side-to-side rocking motion, a front-to-back rocking motion, or both a side-to-side rocking motion and a front-to-back rocking motion.

9 Claims, 19 Drawing Sheets

Related U.S. Application Data

(60) Provisional application No. 62/194,317, filed on Jul. 20, 2015.

(51) Int. Cl.

| | |
|---|---|
| ***A47C 3/02*** | (2006.01) |
| ***A47C 9/00*** | (2006.01) |
| ***A47C 9/02*** | (2006.01) |
| ***A63B 21/00*** | (2006.01) |
| ***A63B 23/02*** | (2006.01) |

(58) Field of Classification Search

CPC ... A63B 21/0004; A63B 23/02; A63B 23/205; A47C 9/002; A47C 1/03261; A47C 1/03266; A61H 2201/0138; A61H 2201/0149

USPC ..... 297/259.1, 270.1, 271.1

See application file for complete search history.

(56) References Cited

U.S. PATENT DOCUMENTS

| | | | | |
|---|---|---|---|---|
| 4,759,542 | A * | 7/1988 | Hudec | A63B 22/16 482/146 |
| 5,004,587 | A | 9/1991 | Degen | |
| 5,113,851 | A | 5/1992 | Gamba | |
| 5,419,615 | A | 5/1995 | Dozsa-Farkas | |
| 5,590,930 | A * | 1/1997 | Glockl | A47C 3/0257 297/258.1 |
| 5,728,049 | A * | 3/1998 | Alberts | A47C 9/002 297/314 |
| 5,873,628 | A | 2/1999 | Allard et al. | |
| 5,913,568 | A | 6/1999 | Brightbill et al. | |
| 6,206,335 | B1 | 3/2001 | Huber et al. | |
| 6,447,070 | B1 * | 9/2002 | Ekman | A47C 3/16 297/344.12 |
| 6,481,795 | B1 | 11/2002 | Pettibon | |
| 6,616,238 | B1 | 9/2003 | Guery-Strahm | |
| 7,093,900 | B1 | 8/2006 | Schon | |
| 7,160,235 | B2 | 1/2007 | McNally et al. | |
| 7,374,517 | B2 | 5/2008 | Lockett | |
| 7,585,028 | B2 | 9/2009 | Jenkins | |
| 7,686,396 | B2 | 3/2010 | Schaaf | |
| 7,775,952 | B1 * | 8/2010 | Curran | A63B 22/18 482/146 |
| 7,922,247 | B2 | 4/2011 | Dickie | |
| 8,007,417 | B2 | 8/2011 | Heller | |
| 8,056,976 | B1 | 11/2011 | Polk | |
| 8,678,985 | B2 | 3/2014 | Mattox | |
| 8,919,881 | B2 | 12/2014 | Bay | |
| 8,926,483 | B1 * | 1/2015 | Holloway | A63B 26/003 297/271.5 |
| 8,998,319 | B2 | 4/2015 | Bahneman et al. | |
| 2002/0156072 | A1 * | 10/2002 | Barbachyn | C07D 263/20 514/227.8 |
| 2004/0009859 | A1 | 1/2004 | Gottlieb | |
| 2006/0097555 | A1 * | 5/2006 | Meleger | A47C 3/16 297/271.6 |
| 2006/0211553 | A1 * | 9/2006 | Cantor | A63B 21/0004 482/146 |
| 2007/0155603 | A1 * | 7/2007 | Cook | A63B 22/18 482/142 |
| 2007/0207906 | A1 * | 9/2007 | Blaum | A63B 22/18 482/146 |
| 2013/0116100 | A1 * | 5/2013 | Chen | A63B 22/18 482/146 |
| 2013/0150220 | A1 * | 6/2013 | Chen | A63B 22/18 482/146 |
| 2014/0045664 | A1 | 2/2014 | Hockridge et al. | |
| 2014/0210249 | A1 | 7/2014 | Barnett | |
| 2014/0378283 | A1 | 12/2014 | Qiu | |
| 2015/0076871 | A1 | 3/2015 | Werner | |

FOREIGN PATENT DOCUMENTS

| | | |
|---|---|---|
| DE | 201 10 832 U1 | 11/2001 |
| DE | 20 2009 004382 U1 | 7/2009 |

OTHER PUBLICATIONS

"Gaiam Balance Ball Chair", Retrieved on Jul. 28, 2015 from http://www.amazon.com/Gaiam-Balance-Ball-Chair-Black/dp/B0007VB4NE/ref=sr_1_1?ie=UTF8&qid=1438110802&sr=8-1&keywords=gaiam+stability+ball+chair.

"Pettibon System Therapeutic Wobble Chair", Available as of Aug. 5, 2013 from http://web.archive.org/web/20130805155721/http://pettibonsystem.com/product/wobble-therapeutic-chair.

"Sivan Health and Fitness Balance Ball Fit Chair Base with Ball and Pump", Retrieved on Jul. 28, 2015 from http://www.amazon.com/Sivan-Health-Fitness-Balance-Chair/dp/B00IYUREDY/ref=sr_1_8?ie=UTF8&qid=1438110802&sr=8-8&keywords=gaiam+stability+ball+chair.

"Zenergy Ball Chair", Retrieved on Jul. 28, 2015 from https://www.schooloutfitters.com/catalog/product_info/pfam_id/PFAM45345/products_id/PRO58109.

Kowalewski, "Wedge Side Tables", DesignBoom. Retrieved from URL: http://www.designboom.com/readers/wedge-side-tables-by-andreas-kowalewski/, Apr. 18, 2012.

Schiffer, "In response to communication pursuant to Rule 96 EPC", related to European Application No. 16 180 094.1, dated Jul. 25, 2017.

Thomas, "International Search Report and Written Opinion", regarding International Application No. PCT/US16/50348, dated Nov. 18, 2016.

White, "Notice of Allowance and Fee(s) Due", related to U.S. Appl. No. 15/275,626, dated May 30, 2017.

Lehe, "European Search Report", related to European Union Application No. EP 16 18 0094, dated Nov. 16, 2016.

* cited by examiner

EXERCISE CHAIR

RELATED APPLICATION DATA

This application is a continuation-in-part of U.S. Design Pat. App. No. 29/540,540, filed Sep. 25, 2015, and entitled "Portion of an Exercise Device", and claims priority to U.S. Provisional Patent App. No. 62/194,317, filed on Jul. 20, 2015, and entitled "Stability Chair," each of which is hereby incorporated by reference herein in their entirety.

FIELD OF THE INVENTION

The presently disclosed subject matter relates generally to exercise devices and more particularly to an Exercise Chair.

BACKGROUND

Human bodies are built to move and generally require constant activity to remain supple and healthy. Unfortunately, modern life involves a good deal of sitting; indeed most professions require many hours of simply sitting, which is an unnatural demand on the human bodies—so unnatural that children instinctively rebel against it.

Sitting, and especially sitting still, aligns human bodies oddly, and denies joints the constant small adjustments that help to circulate the joint fluid which helps nourish the delicate cartilage lining of the joints. Additionally, sitting still denies core muscles the exercise involved in aligning and realigning our spines, exercise vital to keeping our core musculature strong and responsive. Further, extended and repetitive sitting has been linked to other health maladies, such as heart attacks.

The biomechanics of the spine allow the body to accommodate numerous primary ranges of motion; namely, spinal movements such as flexion, right and left extension, right and left rotation, lateral bending, as well as long-axis distraction and compression or load/unload cycles. In conventional chairs or seats, motion and/or static position by the user that results in one or more of these spinal movements causes the user's spine and associated soft tissues to absorb the entire motion and the associated stresses. Static spinal positioning or inadequate seat mobility causes a build-up of spinal irritation, soft tissue pressure, muscle spasm, or loss of tone. Further, there can be circulatory disturbance in the spinal soft tissues resulting in significant stress on the user's spine. Without the ability to compensate for and/or produce these essential movements, the user can frequently experience backaches and eventual spinal pathology after prolonged static sitting.

SUMMARY OF THE DISCLOSURE

In an exemplary embodiment, an exercise chair comprises a rocking assembly including a rocking mechanism, a base plate, and a seat, the rocking mechanism sized and configured to allow a user to rotate at least a portion of the rocking assembly laterally, longitudinally, and transversely, and wherein the rocking mechanism is coupled to the seat; and a fastener coupling the base plate to the rocking assembly, wherein at least a portion of the fastener is made from elastomeric materials so as to assist in the motion of the rocking assembly.

In another exemplary embodiment, an exercise chair comprises a base assembly; a rocking assembly including a rocking mechanism, a base plate, and a seat, the rocking mechanism sized and configured to allow a user to rotate at least a portion of the rocking assembly laterally, longitudinally, and transversely, and wherein the rocking mechanism is coupled to the seat; and a fastener coupled to the base assembly and the rocking assembly, wherein at least a portion of the fastener is made from elastomeric materials so as to assist in the lateral and longitudinal motion of the rocking assembly.

In yet another exemplary embodiment, an exercise chair comprises a base assembly; a rocking assembly releasably coupled to the base assembly, the rocking assembly including a rocking mechanism, a base plate, and a seat, the rocking mechanism sized and configured to allow a user to rotate at least a portion of the rocking assembly laterally, longitudinally, and transversely, and wherein the rocking mechanism is coupled to the seat; and a fastener coupling the base plate to the rocking assembly, wherein at least a portion of the fastener is made from elastomeric materials so as to assist in the motion of the rocking assembly; wherein the rocking assembly, when removed from the base assembly, can be placed on another surface for use by a user while continuing to provide the ability for the user to rotate at least a portion of the rocking assembly laterally, longitudinally, and transversely.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
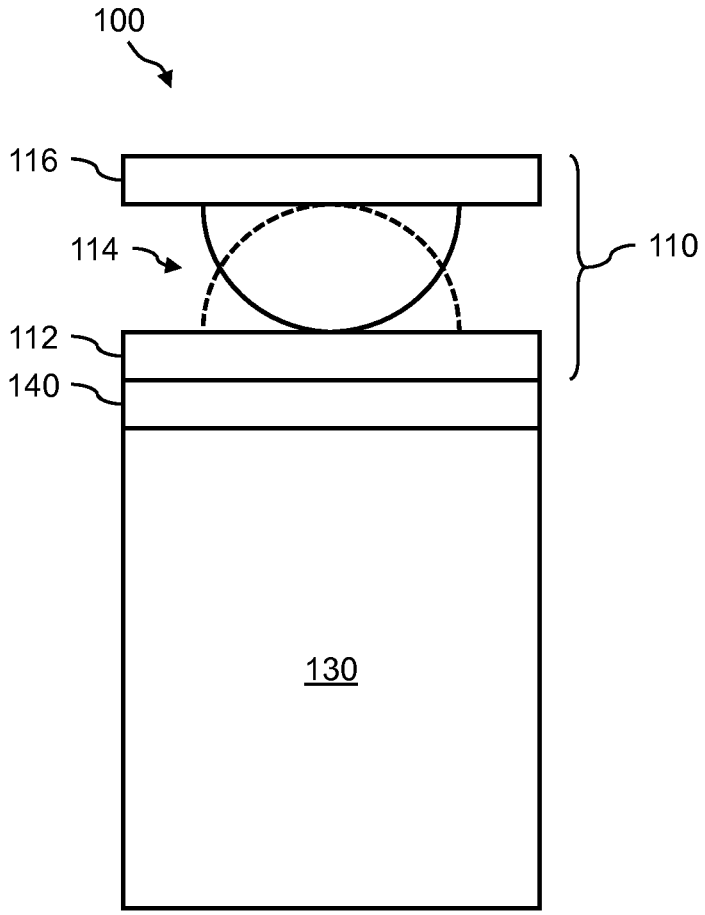
FIG. 1 illustrates a side view of an exercise chair according to an embodiment of the present invention.

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

At a high level, an exercise chair of the present disclosure allows to a user to rock, wobble, and/or swivel with a side-to-side rocking motion, a front-to-back rocking motion, or both a side-to-side rocking motion and a front-to-back rocking motion. In use, an exercise chair according to the present disclosure encourages the user to adopt optimal posture by requiring constant or frequent, if subconscious, rebalancing. The exercise chair can require small adjustments that are relaxing and pleasurable for most users and also serve to exercise the core musculature and small facet joints of the user's spine. As described in more detail below, embodiments of the exercise chair can allow prolonged sitting with less discomfort brought on by poor posture and prolonged static loading of joint surfaces. Additionally, in certain embodiments of the presently disclosed exercise chair, a height adjustment mechanism can be provided between the rocking assembly and the base assembly to accommodate users having differing leg lengths. In yet other embodiments, a locking mechanism is provided for immobilizing the rocking mechanism and the seat as desired.

Generally, the presently disclosed exercise chair includes a rocking assembly that sits atop a base assembly. The rocking assembly can include a base plate or platform for mating to the base assembly, a rocking mechanism that sits atop the base plate, and a seat that sits atop the rocking mechanism. In some embodiments, the rocking mechanism is a hemispheric-shaped or dome-shaped rocking mechanism that interfaces tangentially with a flat surface of either the base plate or the seat. The tangential interface allows multidirectional and/or multidimensional movement of the hemispheric-shaped or dome-shaped rocking mechanism with respect to the flat surface, thereby allowing the user to rock, wobble, and/or swivel the seat with a side-to-side rocking motion, a front-to-back rocking motion, or both a side-to-side and a front-to-back rocking motion.

In other embodiments of the presently disclosed exercise chair, the rocking mechanism of the rocking assembly is an eccentric bicylinder-shaped rocking mechanism that allows multidirectional and/or multidimensional movement of the seat. In yet other embodiments, the rocking mechanism of the rocking assembly is an arrangement of halfpipe members that allow multidirectional and/or multidimensional movement of the seat.

Referring now to FIG. 1, there is shown an exemplary embodiment of an exercise chair, e.g., exercise chair 100, that includes a rocking assembly 110 for exercising the user's spine. Generally, the exercise chair 100 includes a rocking assembly 110 that sits atop a base assembly 130. Optionally, a height adjustment mechanism 140 is provided between the rocking assembly 110 and the base assembly 130.

The base assembly 130 can be any strong and stable structure capable of supporting the weight of a person sitting on the exercise chair 100. Further, the base assembly 130 is sized to accommodate a person in the sitting position on the exercise chair 100. The height adjustment mechanism 140 can be any mechanism for adjusting the height of the rocking assembly 110 with respect to the base assembly 130 and the ground. A specific example of the exercise chair 100 that has a base assembly 130 with four legs and wherein the height adjustment mechanism 140 includes rails is shown and described hereinbelow with reference to FIG. 9 and FIG. 10.

In an exemplary embodiment, the rocking assembly 110 includes a base plate or platform 112, a rocking mechanism 114, and a seat 116. Namely, the rocking mechanism 114 sits atop the base plate 112 and the seat 116 sits atop the rocking mechanism 114. The base plate 112 of the rocking assembly 110 is fastened atop the base assembly 130 (or atop the height adjustment mechanism 140). The base plate 112 of the rocking assembly 110 can take any form depending on the design of the base assembly 130 and/or the height adjustment mechanism 140 as long as it is suitably strong to support a person sitting on the exercise chair 100. Similarly, the seat 116 of the rocking assembly 110 can take any form depending on the overall design of the exercise chair 100. The seat 116 can be, for example, any padded or unpadded seat that is comfortable for the user.

In another exemplary embodiment of rocking assembly 110, rocking assembly is removeably coupled to base assembly 130. In this embodiment, rocking assembly 110 can be attached to base assembly 130 for use by a user in a customary position, e.g., at a desk or table, or rocking assembly 110 can be removed and placed on another stable surface, e.g., the floor, where the user can rest on the rocking assembly.

The rocking mechanism 114 of the rocking assembly 110 can be any mechanism that is suitably strong to support a person sitting on the exercise chair 100 and that provides multidirectional and/or multidimensional movement of the seat 116, thereby allowing the user to rock, wobble, and/or swivel the seat 116 with a side-to-side rocking motion, a front-to-back rocking motion, or both a side-to-side and a front-to-back rocking motion. Because the base plate 112 of the rocking assembly 110 is fastened to the base assembly 130 or to the height adjustment mechanism 140, the plane of the base plate 112 of the rocking assembly 110 is fixed with respect to the base assembly 130. However, the presence of the rocking mechanism 114 between the base plate 112 and the seat 116 allows the seat 116 to rock side-to-side and/or front-to-back with respect to the plane of the base plate 112. In other words, the seat 116 can rock, wobble, and/or swivel with respect to the base assembly 130. Examples of hemispheric- or dome-shaped rocking mechanisms 114 are described hereinbelow with reference to FIGS. 2 to 8. Further, an example of an eccentric bicylinder-shaped rocking mechanism 114 is described hereinbelow with reference to FIGS. 13 to 16B. Additionally, an example of a rocking mechanism 114 that is based on an arrangement of halfpipe members is described hereinbelow with reference to FIG. 17.

Figure 2:
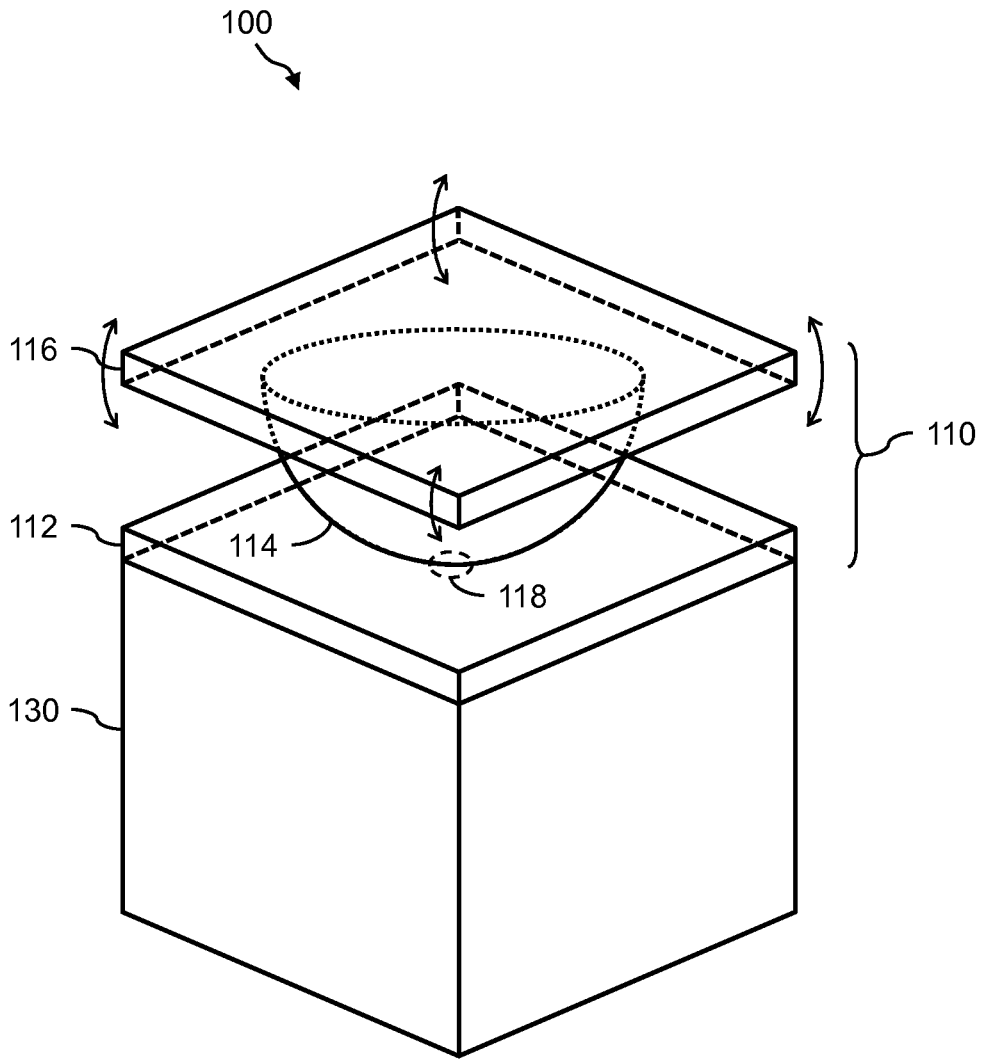
FIG. 2 illustrates a perspective view of an exercise chair according to an embodiment of the present invention.
Figure 3:
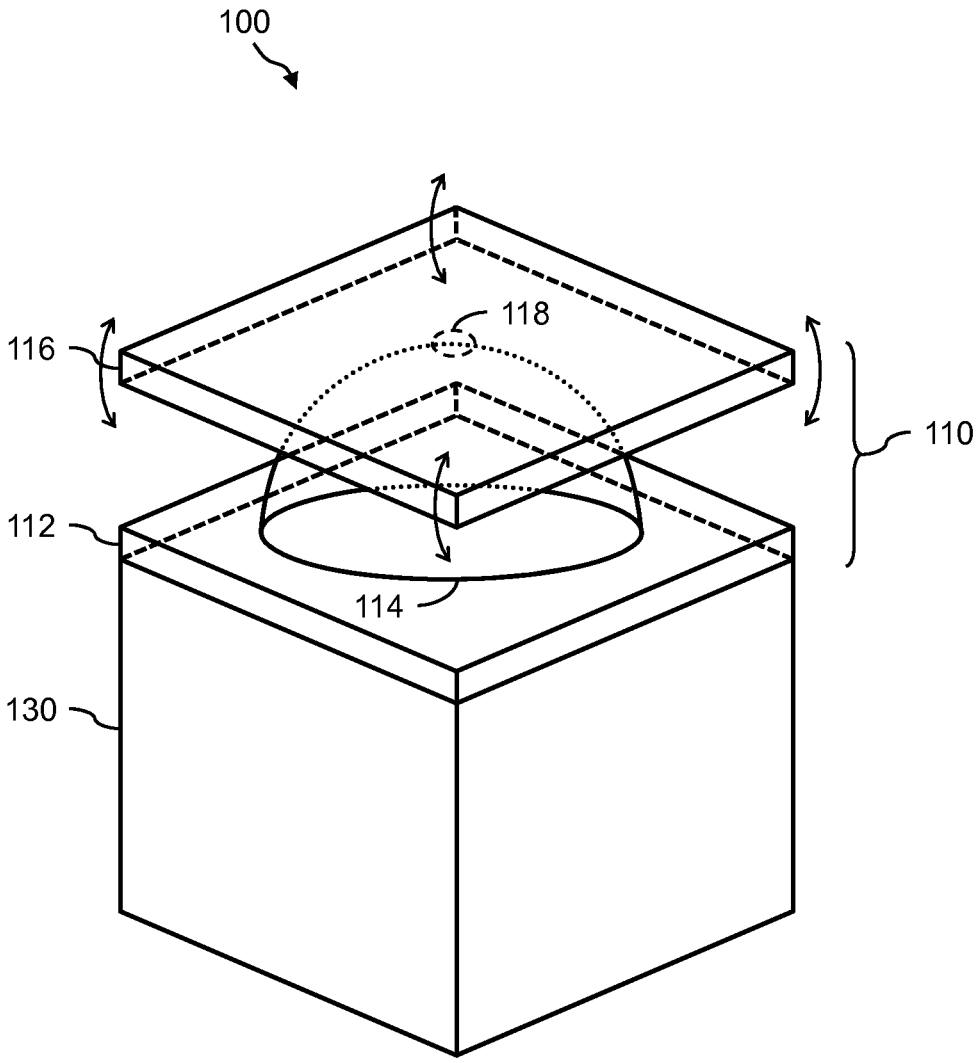
FIG. 3 illustrates a perspective view of another exercise chair according to an embodiment of the present invention.

Referring now to FIG. 2 and FIG. 3, there is shown exemplary embodiments of an exercise chair 100 that include exemplary hemispheric- or dome-shaped rocking mechanisms 114. Namely, FIG. 2 shows an example of a hemispheric- or dome-shaped rocking mechanism 114, wherein the apex of the hemispheric- or dome-shaped rocking mechanism 114 is in contact with the upper surface of the base plate 112 and the flat portion of the hemispheric- or dome-shaped rocking mechanism 114 is in contact with the underside of the seat 116. In this embodiment, the apex of the hemispheric- or dome-shaped rocking mechanism 114 makes tangential contact with the upper surface of the base plate 112 at a contact area 118 of the base plate 112. In an opposite orientation, FIG. 3 shows the apex of the hemispheric- or dome-shaped rocking mechanism 114 in contact with the underside of the seat 116, while the flat portion of the hemispheric- or dome-shaped rocking mechanism 114 is in contact with the upper surface of the base plate 112. In this embodiment, the apex of the hemispheric- or dome-shaped rocking mechanism 114 makes tangential contact with the underside of the seat 116 at the contact area 118.

In FIG. 2, together the seat 116 and the hemispheric- or dome-shaped rocking mechanism 114 can move side-to-side, front-to-back, and combinations of both side-to-side and front-to-back with respect to the base plate 112 and the base assembly 130. However, in FIG. 3, the seat 116 alone can move side-to-side, front-to-back, and combinations of both side-to-side and front-to-back with respect to the hemispheric- or dome-shaped rocking mechanism 114, the base plate 112, and the base assembly 130.

Figure 4:
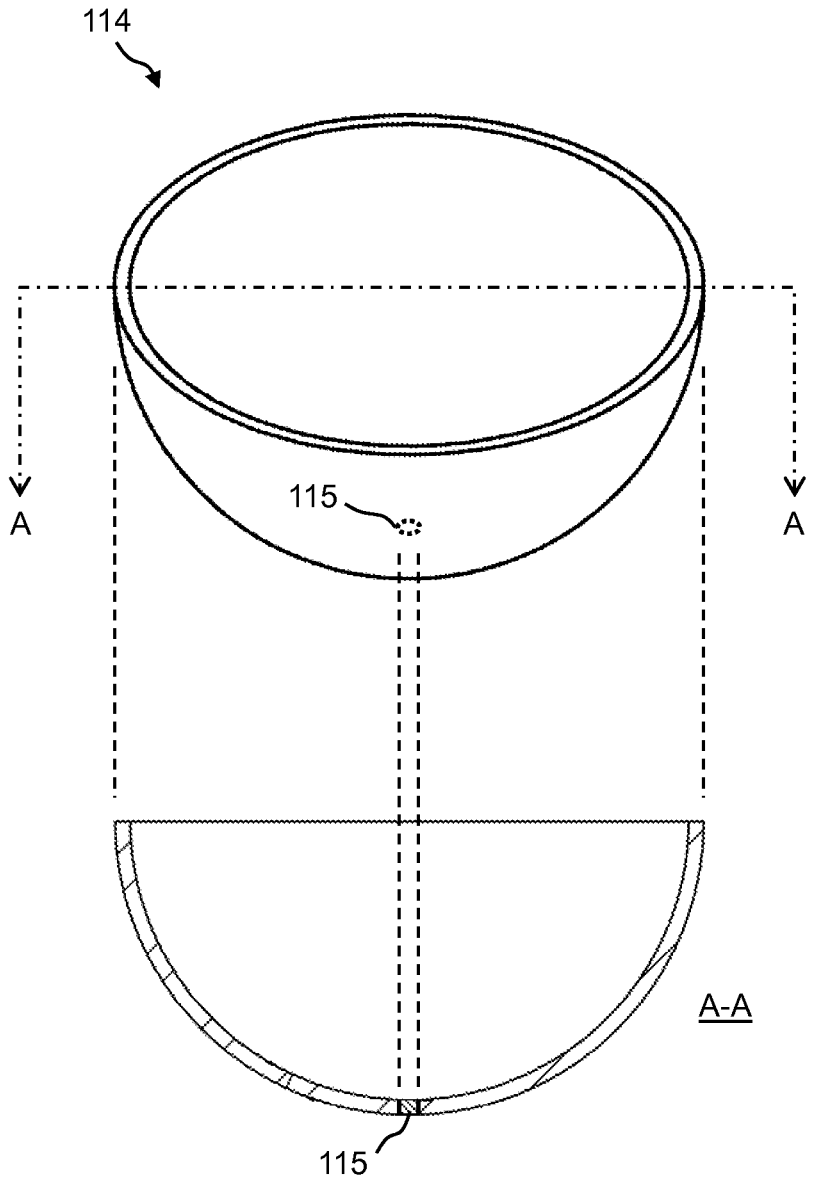
FIG. 4 illustrates a perspective view and a cross-sectional view of an exemplary rocking mechanism for an exercise chair according to an embodiment of the present invention.
Figure 5:
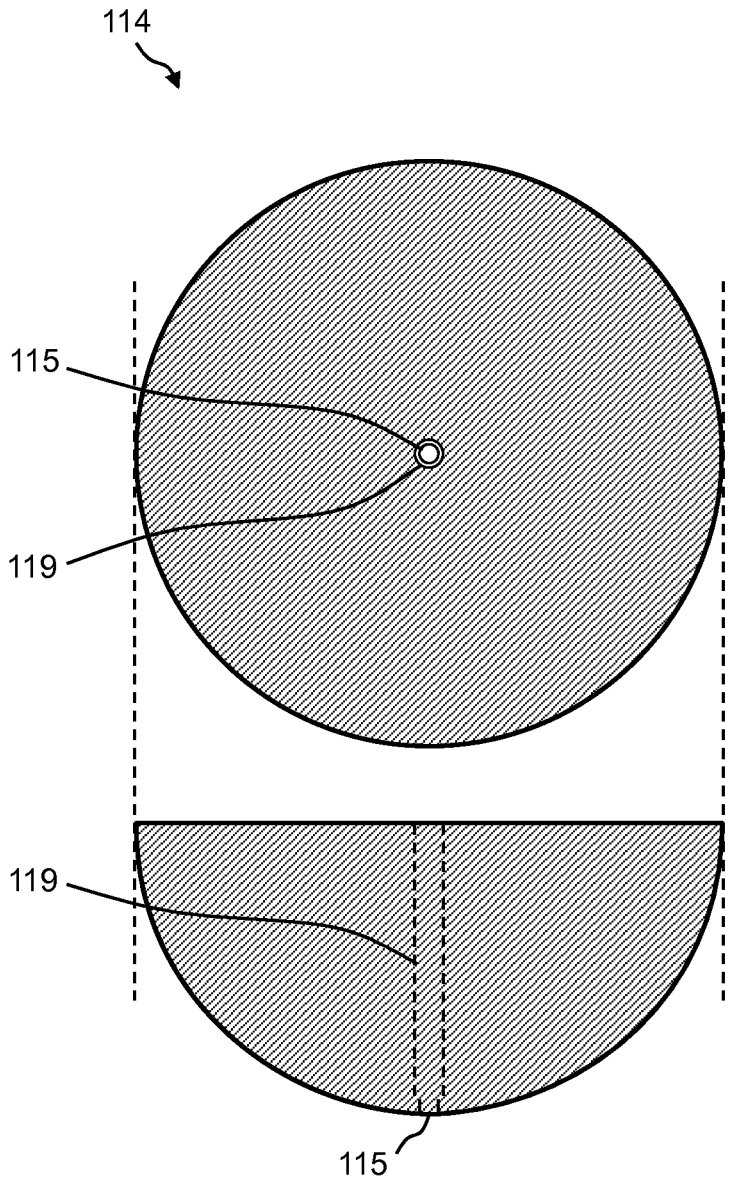
FIG. 5 illustrates a perspective view and a side view of another exemplary rocking mechanism for an exercise chair according to an embodiment of the present invention.

Referring now to FIG. 4, there is shown an exemplary hollow hemispheric- or dome-shaped rocking mechanism 114. A cross-sectional view is also shown and is taken along line A-A of the perspective view of FIG. 4. The hollow hemispheric- or dome-shaped rocking mechanism 114 can be formed, for example, of molded plastic, a polymer material, wood, or metal (e.g., aluminum, stainless steel) and has a wall thickness suitable to resist splaying and deformation. In this embodiment, a through-hole 115 is provided at the apex of the hollow hemispheric- or dome-shaped rocking mechanism 114, wherein the through-hole 115 can facilitate fastening the hollow hemispheric- or dome-shaped rocking mechanism 114 to the base plate 112 or to the seat 116. By contrast, FIG. 5 shows an exemplary embodiment of a solid hemispheric- or dome-shaped rocking mechanism 114 that is substantially solid. The solid hemispheric- or dome-shaped rocking mechanism 114 can be formed, for example, of molded plastic, a polymer material, wood, or metal (e.g., aluminum, stainless steel). An access channel 119 runs through the solid hemispheric- or dome-shaped rocking mechanism 114, leading to the through-hole 115. With respect to any of the hemispheric- or dome-shaped rocking mechanisms 114, the radius can vary. For example, the radius can range from about 6 inches to about 20 inches.

Figure 6:
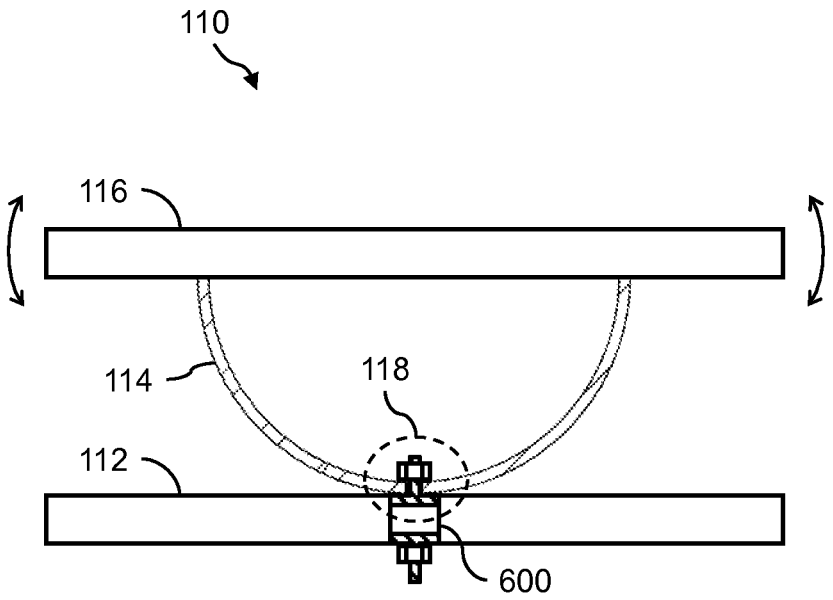
FIG. 6 illustrates a side view of a rocking assembly for an exercise chair according to an embodiment of the present invention.
Figure 7:
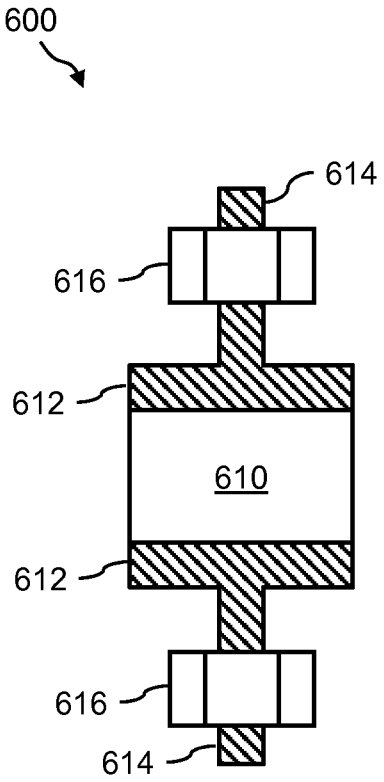
FIG. 7 illustrates a side view of an example of an exemplary fastener used with an exercise chair according to an embodiment of the present invention.

Referring now to FIGS. 6 and 7, there is shown a side view of an exemplary rocking assembly 110 that includes the hollow hemispheric- or dome-shaped rocking mechanism 114 shown in FIG. 4, with the rocking mechanism 114 fastened to the base plate 112 via a fastener 600 (FIG. 7). In an exemplary embodiment, fastener 600 can include an elastomeric portion 610, which may be made of rubber or other similar material that will allow for the multidirectional movement of the rocking assembly 110, and a pair of couplings 612 (one on each end of fastener 600). In an embodiment, elastomeric portion 610 is cylinder-shaped. Each of couplings 612 have a threaded end 614 to which a nut 616 can be attached. A washer (not shown) may also be installed on each of the threaded ends 614 of the couplings 612.

Figure 8:
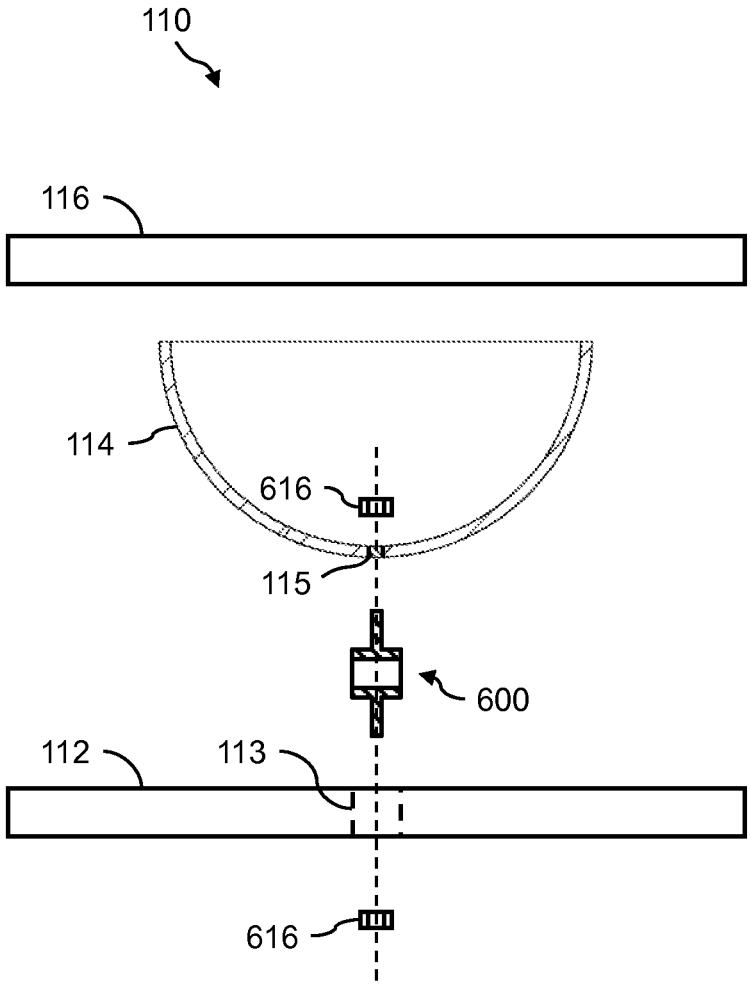
FIG. 8 illustrates an exploded view of the rocking assembly of the exercise chair shown in FIG. 6.

Referring again to FIG. 6 and also now to FIG. 8, an opening 113 is provided in base plate 112 for attachment of the rocking mechanism 114 (and seat 116) to the base plate. In this embodiment, opening 113 is shaped and sized to receive the elastomeric portion 610 of the fastener 600, such that the two threaded ends 614 protrude from opposite sides of the base plate 112. The threaded end 614 facing the hollow hemispheric- or dome-shaped rocking mechanism 114 is fitted into the through-hole 115 of the hollow hemispheric- or dome-shaped rocking mechanism 114. Then the nut 616 can be tightened onto the threaded end 614 for holding securely the hollow hemispheric- or dome-shaped rocking mechanism 114 to the base plate 112.

Fastener 600 serves a plurality of functions—(1) the fastener 600 couples the hollow hemispheric- or dome-shaped rocking mechanism 114 (and the seat 116) to the base plate 112 and base assembly 130, (2) due to its elastic components, the fastener 600 allows a user to rock, wobble, and/or swivel in the seat 116, (3) the fastener 600 allows the hollow hemispheric- or dome-shaped rocking mechanism 114 to move side-to-side, front-to-back, and combinations of both side-to-side and front-to-back, and (4) the fastener 600 returns the seat 116 to a "neutral" position when the user gets up from the exercise chair 100.

Figure 9:
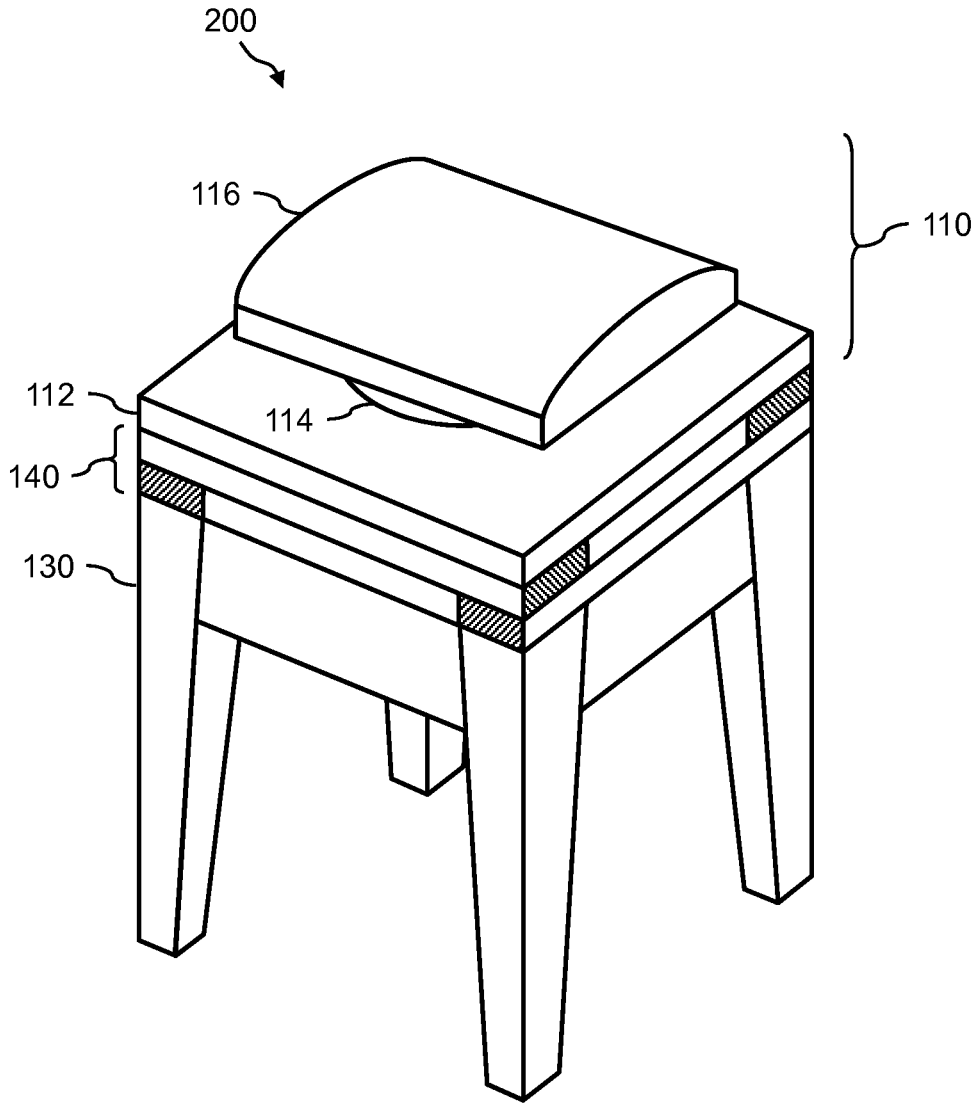
FIG. 9 illustrates a perspective view of an exercise chair according to another embodiment of the present invention.
Figure 10:
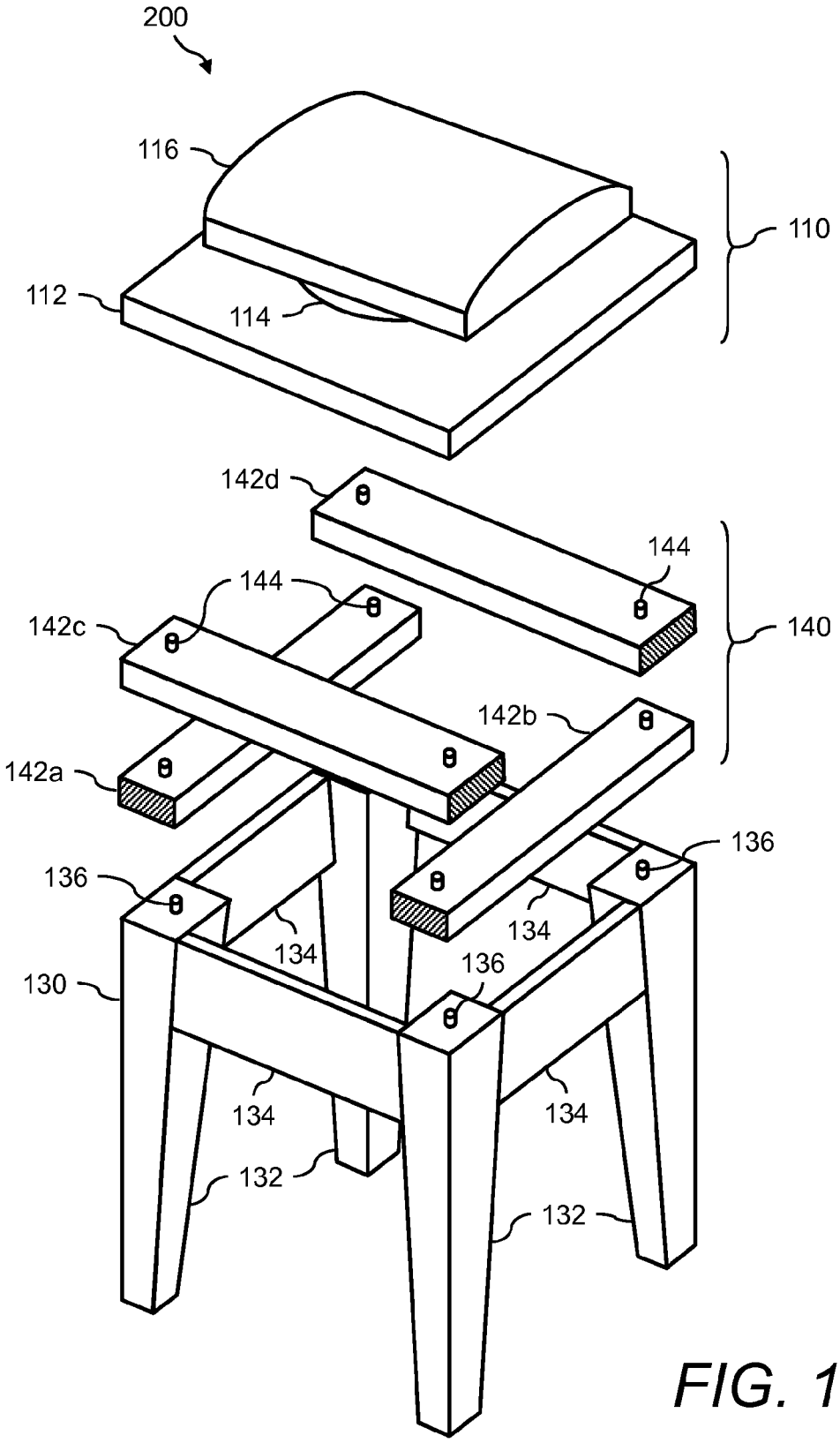
FIG. 10 illustrates an exploded view of the exercise chair shown in FIG. 9.

Referring now to FIGS. 9 and 10, there is shown another exemplary embodiment of an exercise chair; namely, an exercise chair 200. In the exercise chair 200, the base assembly 130 includes four legs 132 that are coupled together at the top by four cross braces 134. However, more or fewer legs 132 may be used. The legs 132 are sized and configured to position a user a certain height above the ground and to provide stability. While cross braces 134 serve to maintain the position of the legs 132, other structures known in the art may be used to ensure that the legs 132 do not splay or otherwise fail to provide stability to the exercise chair 200. The legs 132 may include, on a bottom or distal end, rollers or other devices to allow the exercise chair 200 to roll or move along a floor or other surface. A peg 136 is provided at the top or proximal end of each of the wooden legs 132.

As shown in FIG. 10, exercise chair 200 includes a height adjustment mechanism 140 that includes an arrangement of rail members 142. Each of the rail members 142 has a hole (not shown) facing downward on each end and a peg 144 facing upward on each end. In the embodiment shown in FIG. 10, height adjustment mechanism shows a first pair of rail members 142*a*, 142*b* stacked atop the base assembly 130. The holes (not visible) in rail members 142*a*, 142*b* mate with the pegs 136 of the base assembly 130. A second pair of rail members 142*c*, 142*d* is stacked atop the first pair of rail members 142*a*, 142*b*. The holes (not visible) in the rail members 142*c*, 142*d* mate with the pegs 144 of the rail members 142*a*, 142*b*. In one example, each pair of the rail members 142 adds about 1 inch of height to the exercise chair 200. Depending on the height of the user, the user may decide whether to include one pair of the rail members 142, two pairs of the rail members 142, or no pairs of the rail members 142. In this way, the overall height of the exercise chair 200 can be adjusted to fit the user.

In an exemplary embodiment, base plate 112 of the rocking assembly 110 for exercise chair 200 is a wooden platform. The underside of the base plate 112 may include holes (not visible for receiving the pegs 136 of the base assembly 130 or the pegs 144 of the rail members 142. Further, the seat 116 of the rocking assembly 110 can be a solid or padded seat. For example, the seat 116 may be cushioned or have features that conform to the user to allow for a more comfortable sitting position. In some embodiments, the seat 116 may be a flat surface that somewhat induces uncomfortableness so as to prompt the user to move occasionally.

Additionally, in the exercise chair 200, the rocking mechanism 114 of the rocking assembly 110 can be a solid wooden hemispheric- or dome-shaped rocking mechanism 114, wherein the apex of the hemispheric- or dome-shaped rocking mechanism 114 is facing upward and fastened to the seat 116. The fastener, such as fastener 600, is not visible, wherein the fastener allows the seat 116 to move side-to-side, front-to-back, and combinations of both side-to-side and front-to-back with respect to the hemispheric- or dome-shaped rocking mechanism 114.

Reducing or entirely eliminating the rocking or similar movement of an exercise chair, such as exercise chairs 100 and 200, may be desirable when the user no longer wishes it to move or when the user is finished using the chair (to prevent others from accidently sitting and then being surprised by the movement of the chair). Accordingly, FIGS. 11A, 11B, and 12 show exemplary mechanisms suitable for immobilizing the rocking assembly of the presently disclosed exercise chairs.

Figure 11A:
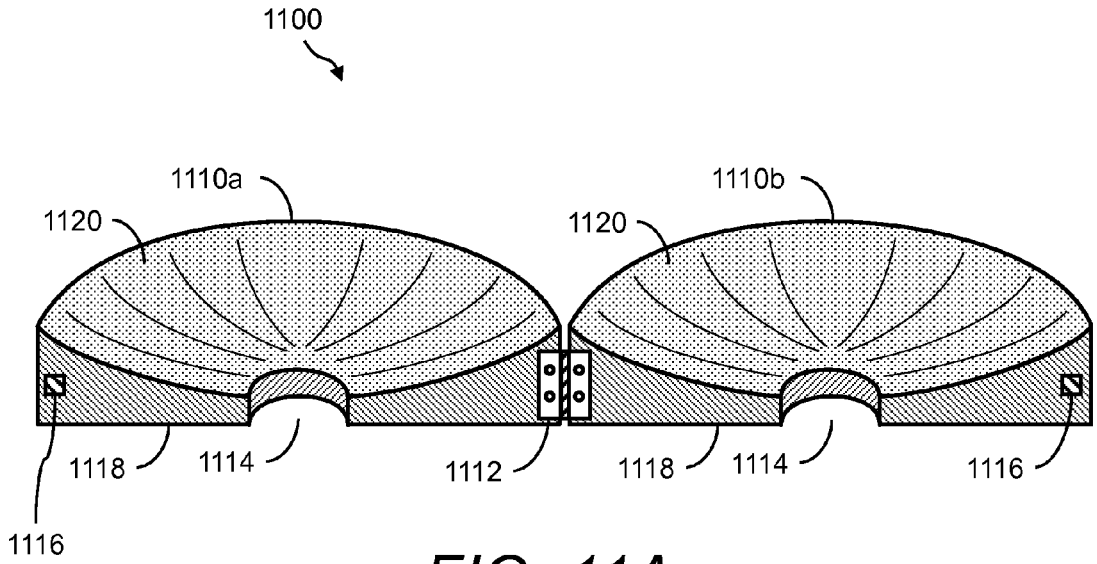
FIG. 11A and FIG. 11B illustrate a perspective view and a top down view, respectively, of an exemplary chock for use with an exercise chair according to embodiment of the present invention.
Figure 11B:
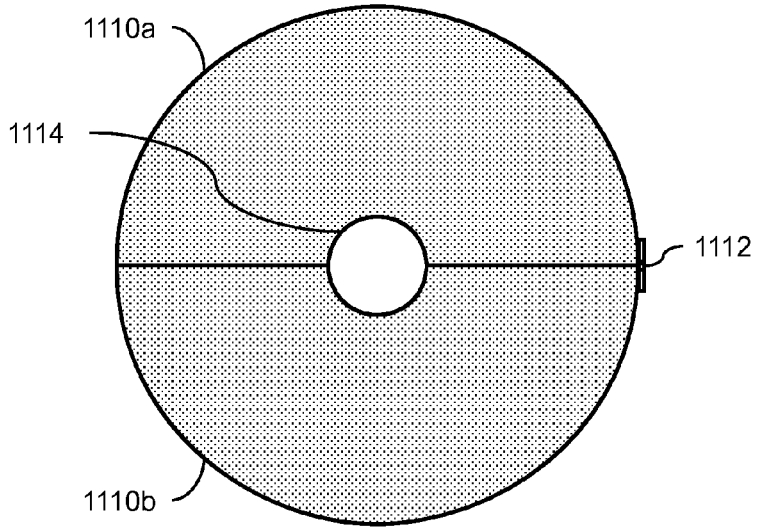
Figure 12:
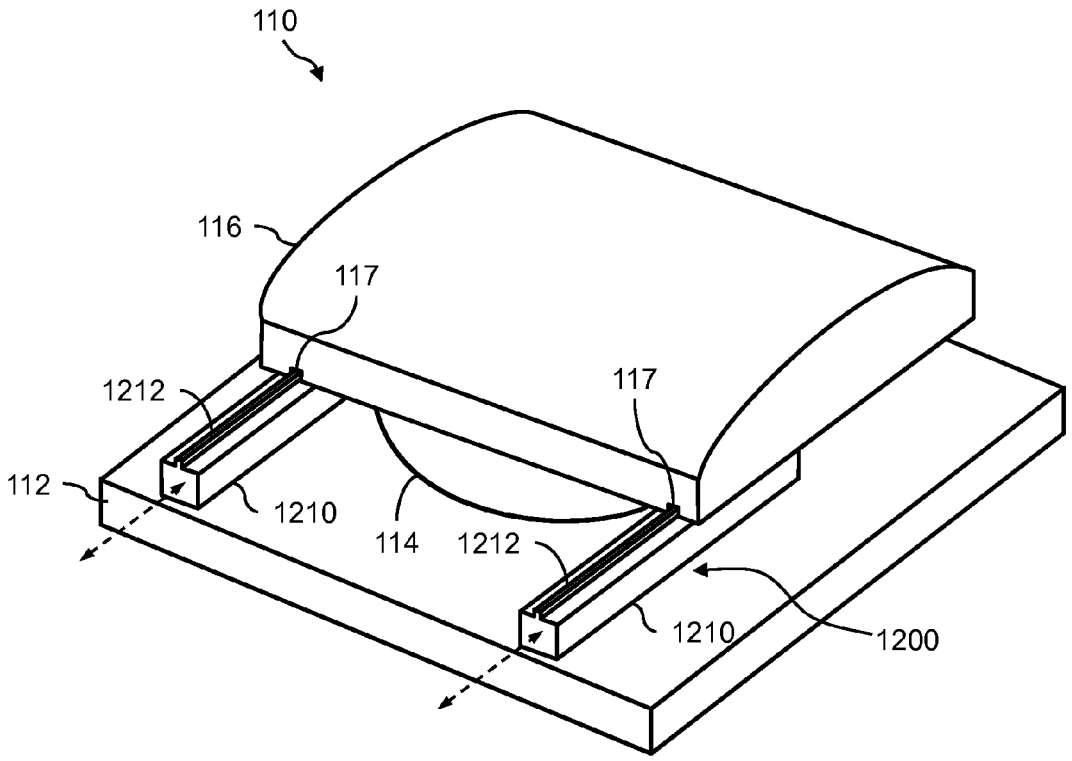
FIG. 12 illustrates a perspective view of another exemplary chock for use with an exercise chair according to embodiment of the present invention.

Referring now to FIG. 11A and FIG. 11B is a perspective view and a top down view, respectively, of an exemplary chock 1100 suitable for immobilizing the seat 116 of the exercise chair, such as exercise chairs 100, 200. Namely, the chock 1100 is designed to inhibit or entirely prevent movement of the seat 116.

In this example, the chock 1100 is generally disk shaped and is formed by two half-disks 1110 (e.g., half-disks 1110*a*, 1110*b*) that are coupled via a hinge 1112. FIG. 11A shows the chock 1100 with the half-disks 1110*a*, 1110*b* in the open position. FIG. 11B shows the chock 1100 with the half-disks 1110*a*, 1110*b* in the closed position. Each of the half-disks 1110*a*, 1110*b* has a clearance region 1114 that when closed provides a fully formed center opening 1114 in the chock 1100. The half-disks 1110*a*, 1110*b* can be held in the close position via a fastening mechanism 1116. The fastening mechanism 1116 can be, for example, a hook and loop system (e.g., Velcro®), any type of magnetic fastener, any type of mechanical fastener, or the like. Optionally, the fastening mechanism 1116 can be omitted.

A surface 1118 of the disk-shaped chock 1100 is substantially flat while an opposite surface 1120 is contoured so as to substantially match the contour of, for example, ones of the rocking mechanisms 114 described herein. Accordingly, the outer periphery of the disk-shaped chock 1100 is taller relative to the inner periphery at the center opening 1114. That is, the surface 1120 of the disk-shaped chock 1100 is substantially bowl-shaped. Further, the center opening 1114 (fully formed when closed) is sized and configured to surround, for example, the fastener 600.

In the chock 1100, the hinge 1112 is used to facilitate the installation and removal of the chock 1100. Namely, when open, the half-disks 1110*a*, 1110*b* of the chock 1100 can be fitted beneath the seat 116 and then closed around any of the hemispheric- or dome-shaped rocking mechanisms 114. In so doing, the chock 1100 fills the space between the base plate 112 and the seat 116. Installation of the disk-shaped chock 1100 inhibits or entirely prevents movement (e.g., rocking, wobbling, and/or swiveling) of the hemispheric- or dome-shaped rocking mechanisms 114 and the seat 116.

Referring now to FIG. 12, there is shown another exemplary chock, chock 1200, which is suitable for immobilizing the rocking assembly 110 of the exercise chair, such as exercise chairs 100, 200. Namely, the chock 1200 is designed to inhibit or entirely prevent movement of the seat 116.

In this example, the chock 1200 includes a pair of rails 1210, each with a guide feature 1212 running along its length. Generally, the rails 1210 are sized and designed to slide between the base plate 112 and the seat 116. The underside of the seat 116 includes grooves 117 for receiving the guide features 1212 of the rails 1210. Installation of the chock 1200 inhibits or entirely prevents movement (e.g., rocking, wobbling, and/or swiveling) of the rocking mechanisms 114 and the seat 116. Further, certain grasping features (not shown) can be formed in the ends of the rails 1210 for easy grasping during installation and removal.

Figure 13:
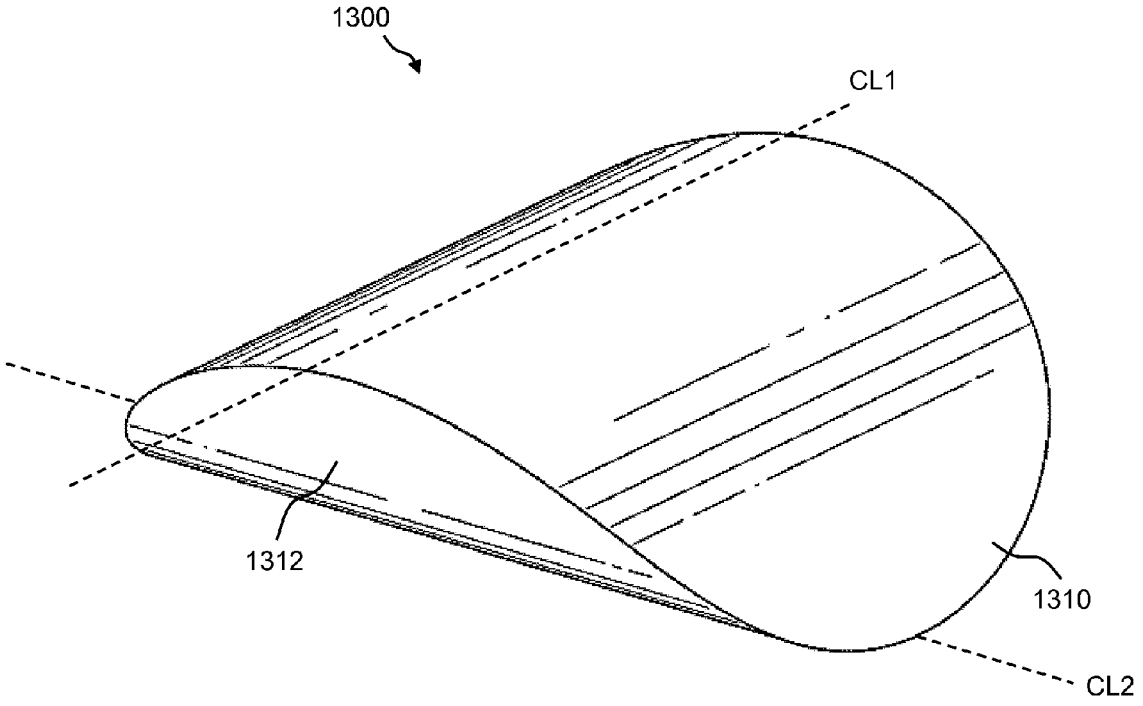
FIG. 13 illustrates a perspective view of another exemplary rocking mechanism for use with an exercise chair according to embodiment of the present invention.
Figure 14:
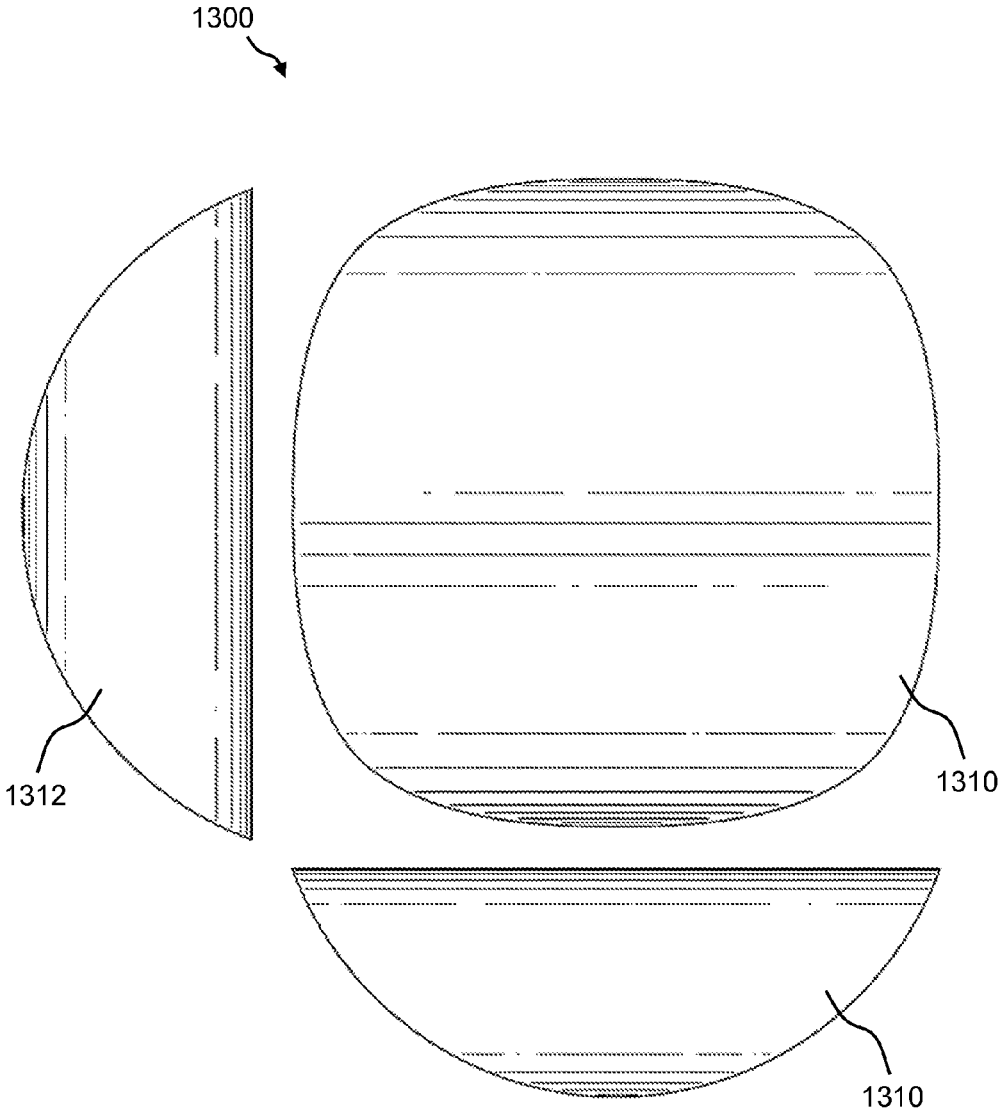
FIG. 14 illustrates a top, a side, and an end view of the rocking mechanism shown in FIG. 13.
Figure 15:
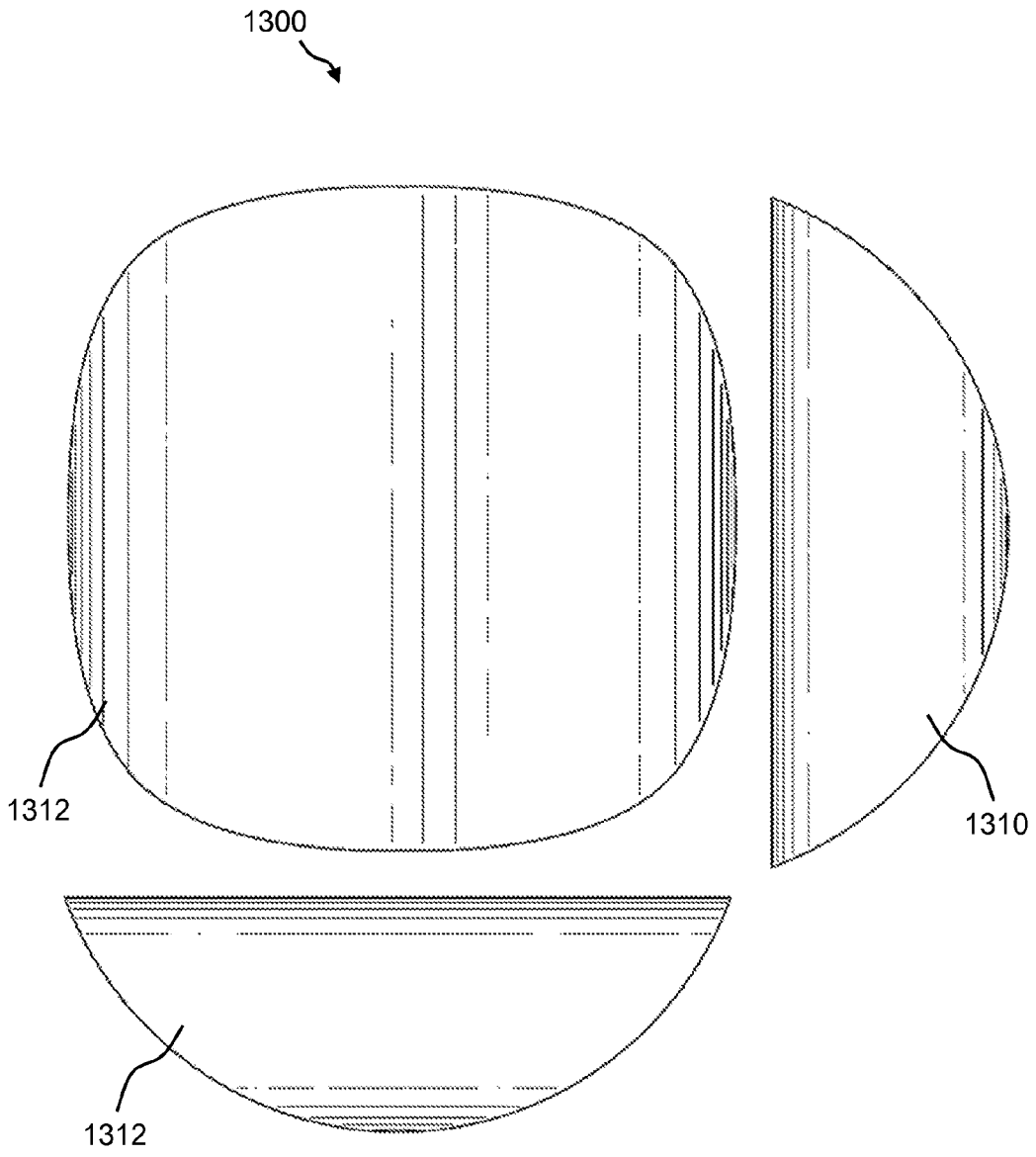
FIG. 15 illustrates a bottom, a side, and an end view of the rocking mechanism shown in FIG. 13.

Referring now to FIGS. 13 to 15, there is shown another exemplary rocking mechanism, rocking mechanism 1300, suitable for inducing wobble and rotation for a user of an exercise device as described herein. In this embodiment, rocking mechanism 1300 has a generally eccentric bicylinder shape. At a high level, rocking mechanism 1300 includes a surface 1310 and a surface 1312 arranged in an eccentric bicylinder shape as shown. FIG. 13 shows a first contact line (CL1) that runs along the apex of the surface 1310 and a second contact line (CL2) that runs along the apex of the surface 1312.

Figure 16A:
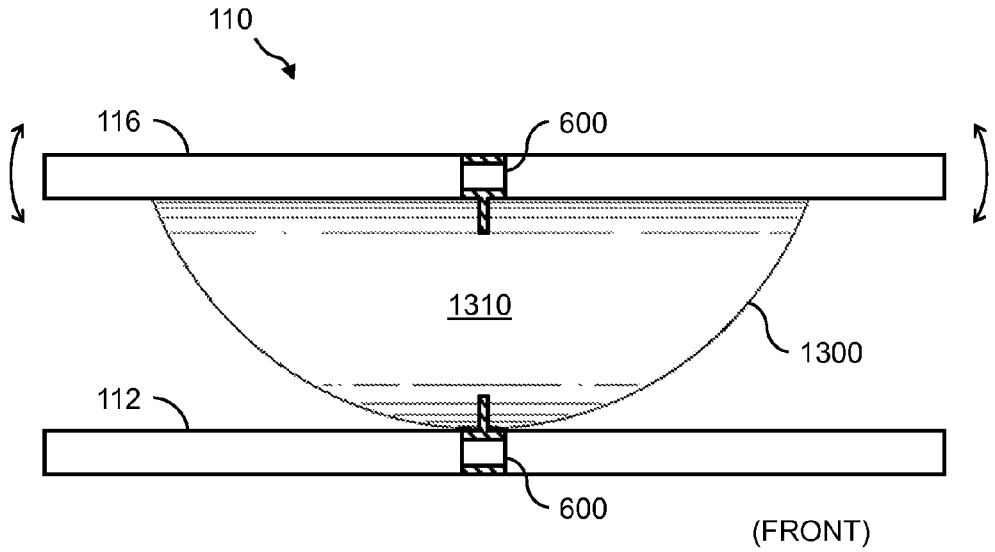
FIG. 16A and FIG. 16B illustrate a front view and a side view, respectively, of the rocking mechanism shown in FIG. 13 in relation to other components of an exercise chair according to embodiment of the present invention.

In operation and referring now to FIG. 16A, the eccentric bicylinder rocking mechanism 1300 is shown in FIG. 13 in relation to the base plate 112 and the seat 116 of, for example, the exercise chair 100. In this view, the seat 116 is fastened to the apex of the surface 1310 of the eccentric bicylinder rocking mechanism 1300. Namely, the seat 116 contacts the eccentric bicylinder rocking mechanism 1300 along the first contact line (CL1) of the surface 1310, wherein the seat 116 can rock, wobble, and/or swivel about the first contact line (CL1). In certain embodiments of the exercise chair discussed herein, the rocking mechanism, such as rocking mechanism 1300, maybe replaceable with other types of rocking mechanisms so as to customize the degree of rotatability for the user. In other words, and using as an example, rocking mechanism 1300, if the radius of curvature of the surfaces of the rocking mechanism are high, the rocking mechanism can allow for more extreme, some might say, volatile, movement. In contrast, if the radius of curvature of the surfaces of the rocking mechanism are relatively low, the rocking mechanism can allow for less extreme movements.

Figure 16B:
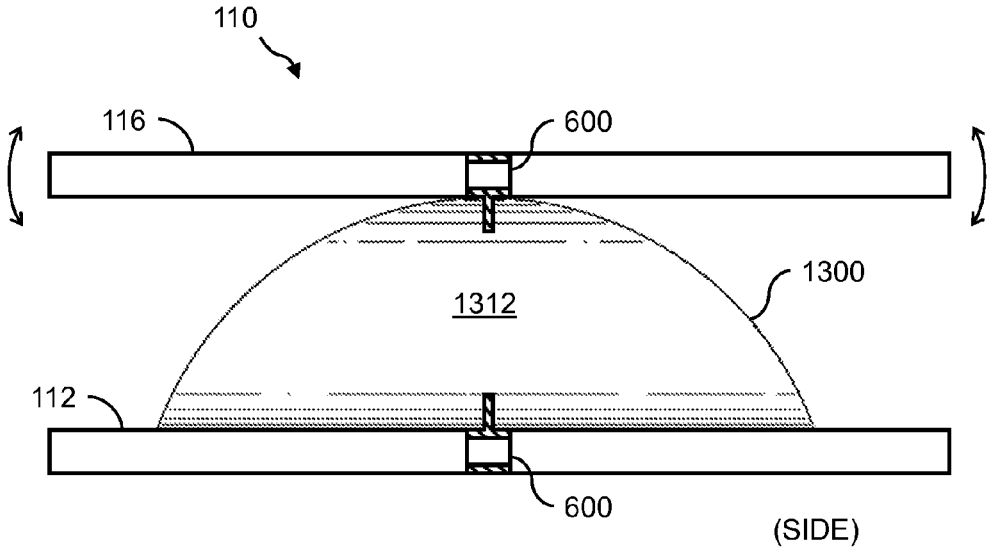

Referring now to FIG. 16B, there is shown a side view of the eccentric bicylinder rocking mechanism 1300 shown in FIG. 13 in relation to the base plate 112 and the seat 116 of, for example, the exercise chair 100. In this view, the base plate 112 is fastened to the apex of the surface 1312 of the eccentric bicylinder rocking mechanism 1300. In this embodiment, the base plate 112 contacts the eccentric bicylinder rocking mechanism 1300 along the second contact line (CL2) of the surface 1312, wherein the base plate 112 can rock, wobble, and/or swivel about the second contact line (CL2).

The combination of the seat 116 moving about the first contact line (CL1) and the base plate 112 moving about the second contact line (CL2), facilitates the multidirectional and/or multidimensional movement of the seat 116, thereby allowing the user to rock, wobble, and/or swivel the seat 116 with a side-to-side rocking motion, a front-to-back rocking motion, or both a side-to-side and a front-to-back rocking motion.

Figure 17:
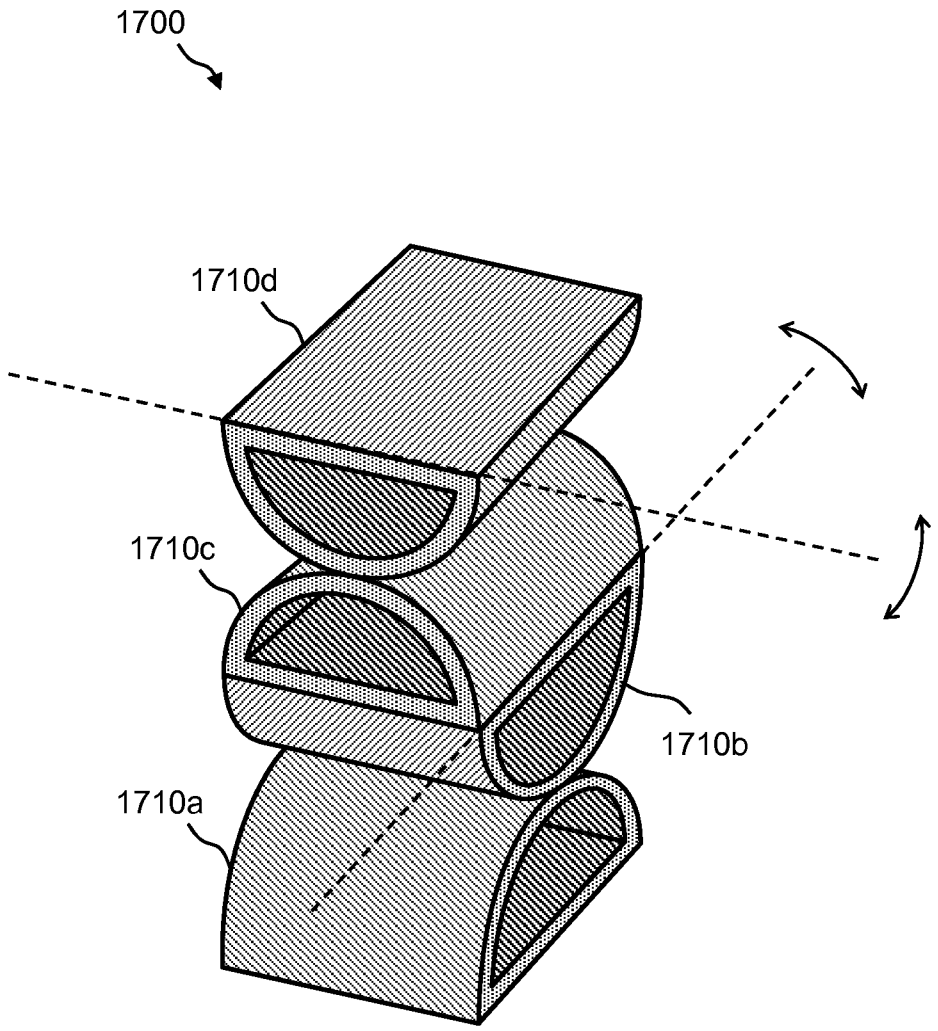
FIG. 17 illustrates a perspective view of another embodiment of a rocking mechanism for use with an exercise chair according to embodiment of the present invention.

Referring now to FIG. 17, there is shown yet another embodiment of a rocking mechanism, rocking mechanism 1700. At a high level, rocking mechanism 1700 includes an arrangement of four halfpipe members 1710 that allow multidirectional and/or multidimensional movement of the seat 116. In this embodiment, rocking mechanism 1700 includes, in order from bottom to top, halfpipe members 1710*a*, 1710*b*, 1710*c*, 1710*d*. More specifically, the halfpipe member 1710*a* is arranged rounded side down and flat side up. Then, the flat side of the halfpipe member 1710*b* is placed atop the flat side of the halfpipe member 1710*a*, wherein the lengths of the halfpipe members 1710*a*, 1710*b* are arranged together as shown. Accordingly, the rounded side of the halfpipe member 1710*a* is facing down and the rounded side of the halfpipe member 1710*b* is facing up. Next, the orientation of the halfpipe member 1710*c* is turned 90 degrees relative to the orientation of the halfpipe members 1710*a*, 1710*b*, then the rounded side of the halfpipe member 1710*c* is placed against the rounded side of the halfpipe member 1710*b*. The flat side of the halfpipe member 1710*c* is facing up. Next, the flat side of the halfpipe member 1710*d* is placed atop the flat side of the halfpipe member 1710*c*, wherein the lengths of the halfpipe members 1710*c*, 1710*d* are arranged together as shown.

The interface of the halfpipe member 1710*a* to the halfpipe member 1710*b* provides an axis of motion in one direction (e.g., side-to-side rocking motion when installed in exercise chair 100). The interface of the halfpipe member 1710*c* to the halfpipe member 1710*d* provides an axis of motion in the other direction (e.g., front-to-back rocking motion when installed in exercise chair 100). Those skilled in the art will recognize that other supporting components, features, and/or structures (not shown) are provided in combination with the rocking mechanism 1700 for installation within the presently disclosed exercise chair.

Figure 18:
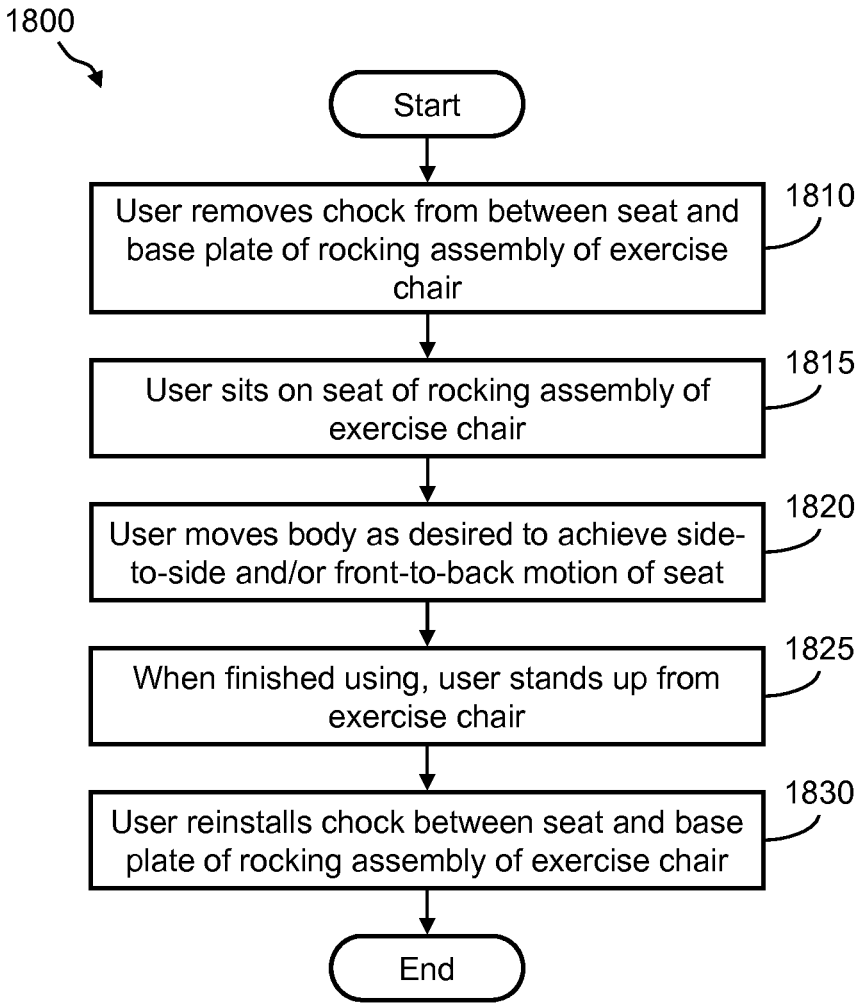
FIG. 18 illustrates a block diagram of an exemplary method of using the presently disclosed exercise chair.

Referring now to FIG. 18 is a flow diagram of an example of a method 1800 of using the presently disclosed exercise chair 100 or 200. The method 1800 may include, but it not limited to, the following steps.

At a step 1810, the user removes the chock from between the seat and the base plate of the rocking assembly of the exercise chair. For example, the user removes the chock 1100 or the chock 1200 from between the seat 116 and the base plate 112 of the rocking assembly 110 of the exercise chair 100 or 200.

At a step 1815, the user sits on the seat of the rocking assembly of the exercise chair. For example, the user sits on the seat 116 of the rocking assembly 110 of the exercise chair 100 or 200.

At a step 1820, the user moves his/her body as desired to achieve side-to-side and/or front-to-back motion of the seat 116 of the rocking assembly 110 of the exercise chair 100 or 200. In so doing, the user exercises the core musculature and small facet joints of his/her spine.

At a step 1825, when the user is finished using the exercise chair 100 or 200, he/she stands up from the exercise chair 100 or 200.

At a step 1830, the user reinstalls the chock between seat and base plate of rocking assembly of exercise chair. For example, the user reinstalls the chock 1100 or the chock 1200 between the seat 116 and the base plate 112 of the rocking assembly 110 of the exercise chair 100 or 200.

Figure 19:
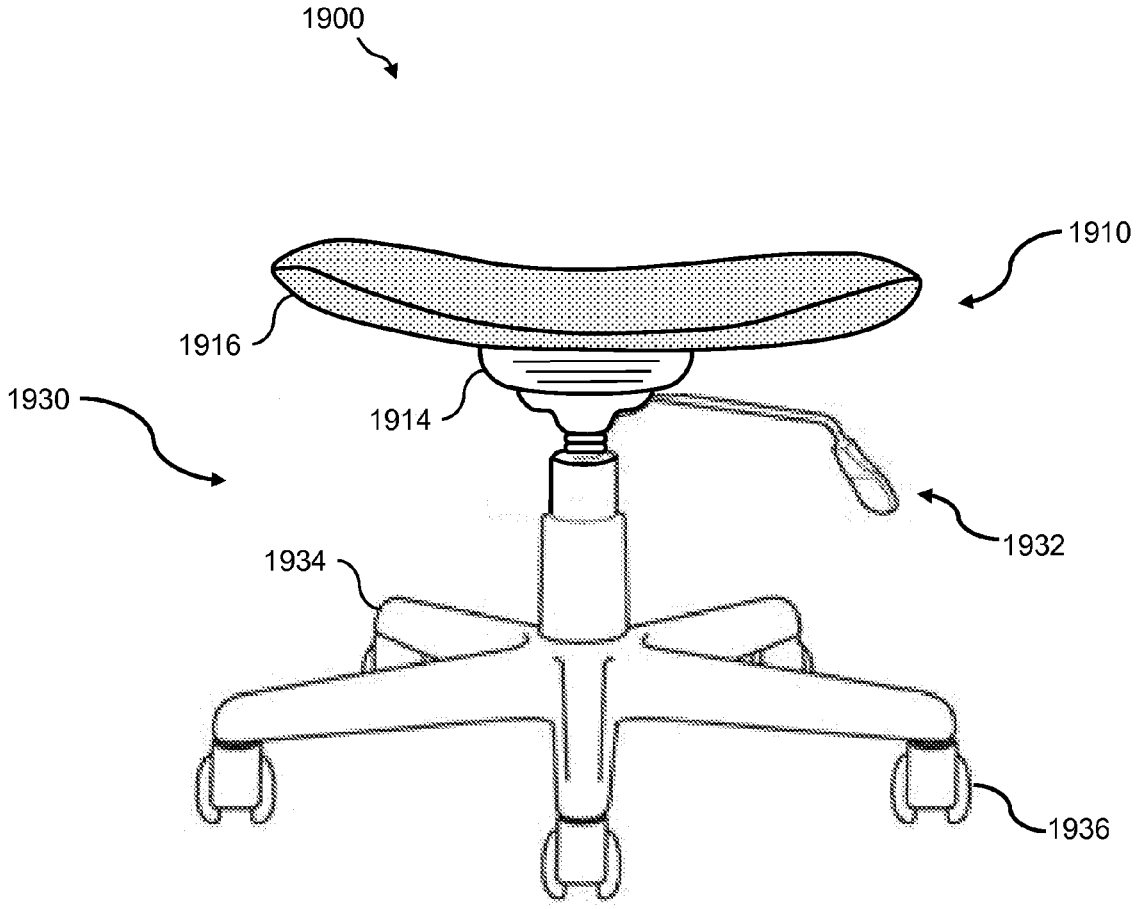
FIG. 19 is a perspective view of yet another exercise chair according to an embodiment of the present disclosure.

Turning now to FIG. 19, there is shown an exercise chair 1900 according to an embodiment of the present disclosure. Exercise chair 1900 includes a rocking assembly 1910 coupled to a base assembly 1930. Rocking assembly 1910 includes a rocking mechanism 1914 (which can be sized and configured similar to rocking mechanism 1300), and a seat 1916. Base assembly 1930 includes a height adjustment mechanism 1932, which can be a manual or pneumatic actuator, and a plurality of generally radially arranged legs 1934, each with a roller 1936.

As with other exercise chairs described herein, rocking assembly 1910 is coupled to base assembly 1930, using, for example, a fastener (not shown) the same as or similar to, fastener 600 (FIGS. 6 and 7).

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

What is claimed is:

1. An exercise chair comprising:

a rocking mechanism, the rocking mechanism having:

an upper portion with an upper contact line running along an upper apex of the rocking mechanism, a first downward curving surface curving downward from a first side of the upper contact line, and a second downward curving surface curving downward from a second side of the upper contact line, and a lower portion with a lower contact line running along a lower apex of the rocking mechanism that is substantially perpendicular to the upper contact line, a first upward curving surface curving upward from a first side of the lower contact line, and a second upward curving surface curving upward from a second side of the lower contact line, wherein the first upward curving surface curves up from the lower contact line and extends until intersecting the first downward curving surface, the second downward curving surface, or the upper contact line, thereby forming a first end of the upper contact line, wherein the second upward curving surface curves up from the lower contact line and extends until intersecting the first downward curving surface, the second downward curving surface, or the upper contact line, thereby forming a second end of the upper contact line, wherein the first downward curving surface curves down from the upper contact line and extends until intersecting the first upward curving surface, the second upward curving surface, or the lower contact line, thereby forming a first end of the lower contact line, and wherein the second downward curving surface curves down from the upper contact line and extends until intersecting the first upward curving surface, the second upward curving surface, or the lower contact line, thereby forming a second end of the lower contact line;

a base plate including a top that forms a base plate top plane;

a seat including a bottom that forms a seat bottom plane;

a fastener coupling the base plate to the lower portion of the rocking mechanism such that the lower contact line is disposed along the base plate top plane such that the rocking mechanism is configured to pivot about the lower contact line, wherein at least a portion of the fastener is made from elastomeric materials that are sized and configured to allow for movement, in addition to the pivoting about the lower contact line, between the rocking mechanism and the base plate, including rotational motion in the base plate top plane; and a second fastener coupling the upper portion of the rocking mechanism to the seat such that the upper contact line is disposed along the seat bottom plane such that the seat is configured to pivot about the upper contact line, wherein at least a portion of the second fastener is made from elastomeric materials that are sized and configured to allow for movement, in addition to the pivoting about the upper contact line, between the rocking mechanism and the seat.

2. The exercise chair according to claim 1, further including a base assembly, the base assembly coupled to the base plate.

3. The exercise chair according to claim 2, further including a height adjustment mechanism having a plurality of rail members.

4. An exercise chair comprising:

a rocking assembly including a rocking mechanism, a base plate, and a seat, the rocking mechanism sized and configured to al low a user to rotate at least a portion of the rocking assembly laterally, longitudinally, and transversely, wherein the rocking mechanism is coupled to the seat, and wherein the rocking mechanism includes:

an upper portion with an upper contact line running along an upper apex of the rocking mechanism, a first downward curving surface curving downward from a first side of the upper contact line, and a second downward curving surface curving downward from a second side of the upper contact line, and a lower portion with a lower contact line running along a lower apex of the rocking mechanism that is substantially perpendicular to the upper contact line, a first upward curving surface curving upward from a first side of the lower contact line, and a second upward curving surface curving upward from a second side of the lower contact line, wherein the first upward curving surface curves up from the lower contact line and extends until intersecting the first downward curving surface, the second downward curving surface, or the upper contact line, thereby forming a first end of the upper contact line, wherein the second upward curving surface curves up from the lower contact line and extends until intersecting the first downward curving surface, the second downward curving surface, or the upper contact line, thereby fainting a second end of the upper contact line, wherein the first downward curving surface curves down from the upper contact line and extends until intersecting the first upward curving surface, the second upward curving surface, or the lower contact line, thereby forming a first end of the lower contact line, and wherein the second downward curving surface curves down from the upper contact line and extends until intersecting the first upward curving surface, the second upward curving surface, or the lower contact line, thereby forming a second end of the lower contact line;

a fastener coupling the base plate to the rocking mechanism, wherein at least a portion of the fastener is made from elastomeric materials so as to assist in the motion of the rocking assembly; and a plurality of rails wherein the base plate includes a plurality of slots, and wherein each of the plurality of rails includes a guide sized and configured to mate with a corresponding respective one of the plurality of slots in the base plate.

5. An exercise chair comprising:

a base assembly including a base plate, the base plate including a base plate upper portion;

an eccentric bicylinder-shaped rocking mechanism including:

an upper portion with an upper contact line running along an upper apex of the rocking mechanism, a first downward curving surface curving downward from a first side of the upper contact line, and a second downward curving surface curving downward from a second side of the upper contact line, and a lower portion with a lower contact line running along a lower apex of the rocking mechanism that is substantially perpendicular to the upper contact line, a first upward curving surface curving upward from a first side of the lower contact line, and a second upward curving surface curving upward from a second side of the lower contact line, wherein the first upward curving surface curves up from the lower contact line and extends until intersecting the first downward curving surface, the second downward curving surface, or the upper contact line, thereby forming a first end of the upper contact line, wherein the second upward curving surface curves up from the lower contact line and extends until intersecting the first downward curving surface, the second downward curving surface, or the upper contact line, thereby forming a second end of the upper contact line, wherein the first downward curving surface curves down from the upper contact line and extends until intersecting the first upward curving surface, the second upward curving surface, or the lower contact line, thereby forming a first end of the lower contact line, and wherein the second downward curving surface curves down from the upper contact line and extends until intersecting the first upward curving surface, the second upward curving surface, or the lower contact line, thereby forming a second end of the lower contact line;

a seat including a seat lower portion;

a fastener coupled to the upper portion of the base plate and the lower portion of the rocking mechanism, wherein at least a portion of the fastener is made from elastomeric materials so as to assist in allowing rotational and rocking motion between the base plate and the rocking mechanism when a user is on the seat; and a second fastener coupled to the upper portion of the rocking mechanism and the lower portion of the seat, wherein at least a portion of the second fastener is made from elastomeric materials so as to assist in allowing rotational and rocking motion between the rocking mechanism and the seat when the user is on the seat.

6. The exercise chair according to claim 5, further including a height adjustment mechanism having a plurality of rail members.

7. The exercise chair according to claim 5, wherein the rocking mechanism is a unitary body.

8. The exercise chair according to claim 5, wherein the rocking assembly is detachable from the base assembly.

9. An exercise chair comprising:

a base assembly;

a rocking assembly releasably coupled to the base assembly, the rocking assembly including a rocking mechanism, a base plate, and a seat, the rocking mechanism sized and configured to al low a user to rotate at least a portion of the rocking assembly laterally, longitudinally, and transversely, wherein the rocking mechanism is coupled to the seat and wherein the rocking mechanism has:

an upper portion with an upper contact line running along an upper apex of the rocking mechanism, a first downward curving surface curving downward from a first side of the upper contact line, and a second downward curving surface curving downward from a second side of the upper contact line, and a lower portion with a lower contact line running along a lower apex of the rocking mechanism that is substantially perpendicular to the upper contact line, a first upward curving surface curving upward from a first side of the lower contact line, and a second upward curving surface curving upward from a second side of the lower contact line, wherein the first upward curving surface curves up from the lower contact line and extends until intersecting the first downward curving surface, the second downward curving surface, or the upper contact line, thereby forming a first end of the upper contact line, wherein the second upward curving surface curves up from the lower contact line and extends until intersecting the first downward curving surface, the second downward curving surface, or the upper contact line, thereby forming a second end of the upper contact line, wherein the first downward curving surface curves down from the upper contact line and extends until intersecting the first upward curving surface, the second upward curving surface, or the lower contact line, thereby forming a first end of the lower contact line, and wherein the second downward curving surface curves down from the upper contact line and extends until intersecting the first upward curving surface, the second upward curving surface, or the lower contact line, thereby forming a second end of the lower contact line; and a fastener coupling the base plate to the rocking mechanism, wherein at least a portion of the fastener is made from elastomeric materials so as to allow for motion between the rocking mechanism and the base plate when the user is on the seat;

wherein the rocking assembly, when removed from the base assembly, is configured to be placed on another surface for use by the user while continuing to allow the user on the seat to rotate at least a portion of the rocking assembly laterally, longitudinally, and transversely.

* * * * *